United States Patent [19]

Klötzer et al.

[11] 3,935,014

[45] Jan. 27, 1976

[54] DIRECT-POSITIVE PHOTOGRAPHIC EMULSION CONTAINING, UNFOGGED, MONODISPERSED SILVER HALIDE GRAINS HAVING A LAYERED GRAIN STRUCTURE OF SPECIFIC SILVER CHLORIDE CONTENT

[75] Inventors: Sieghart Klötzer; Erik Moisar, both of Cologne, Germany

[73] Assignee: Agfa-Gevaert Aktiengesellschaft, Leverkusen-Bayerwerk, Germany

[22] Filed: Feb. 14, 1974

[21] Appl. No.: 442,614

[30] Foreign Application Priority Data

Feb. 20, 1973 Germany ..... 2308239

[52] U.S. Cl. ..... 96/64; 96/107; 96/108; 96/94 R; 96/113; 96/114; 96/114.7

[51] Int. Cl.[2] ..... G03C 5/24; G03C 1/02

[58] Field of Search..... 96/64, 94 R, 107, 108, 96/113–114, 114.7

[56] References Cited

UNITED STATES PATENTS

| | | | |
|---|---|---|---|
| 2,592,250 | 3/1949 | Davey et al. | 96/114.7 |
| 3,206,313 | 9/1965 | Porter et al. | 96/107 |
| 3,317,322 | 5/1967 | Porter et al. | 96/107 |
| 3,367,778 | 2/1968 | Berriman | 96/108 |
| 3,586,505 | 6/1971 | Ridgway | 96/107 |
| 3,761,266 | 9/1973 | Milton | 96/107 |

*Primary Examiner*—Won H. Louie, Jr.
*Attorney, Agent, or Firm*—Connolly and Hutz

[57] ABSTRACT

A direct-positive photographic material for producing images by fogging development wherein the photographic material contains an unfogged silver halide emulsion layer. The silver halide grains in the unfogged emulsion have a layered grain structure wherein there is a first phase in which is localized a relatively high silver chloride content of at least 20 mol percent based on the total silver halide content of the grain. A second phase contains from less silver chloride than the first phase down to no silver chloride and the total silver chloride in the grain does not exceed 30 mol percent.

The physical position of the first phase in the grain is not critical.

The emulsion is either not chemically sensitized or only slightly sensitized.

The photographic material and its use includes both producing black and white and colored photographic images and has high sensitivity to light and by fogging development yields pure image whites.

13 Claims, 1 Drawing Figure

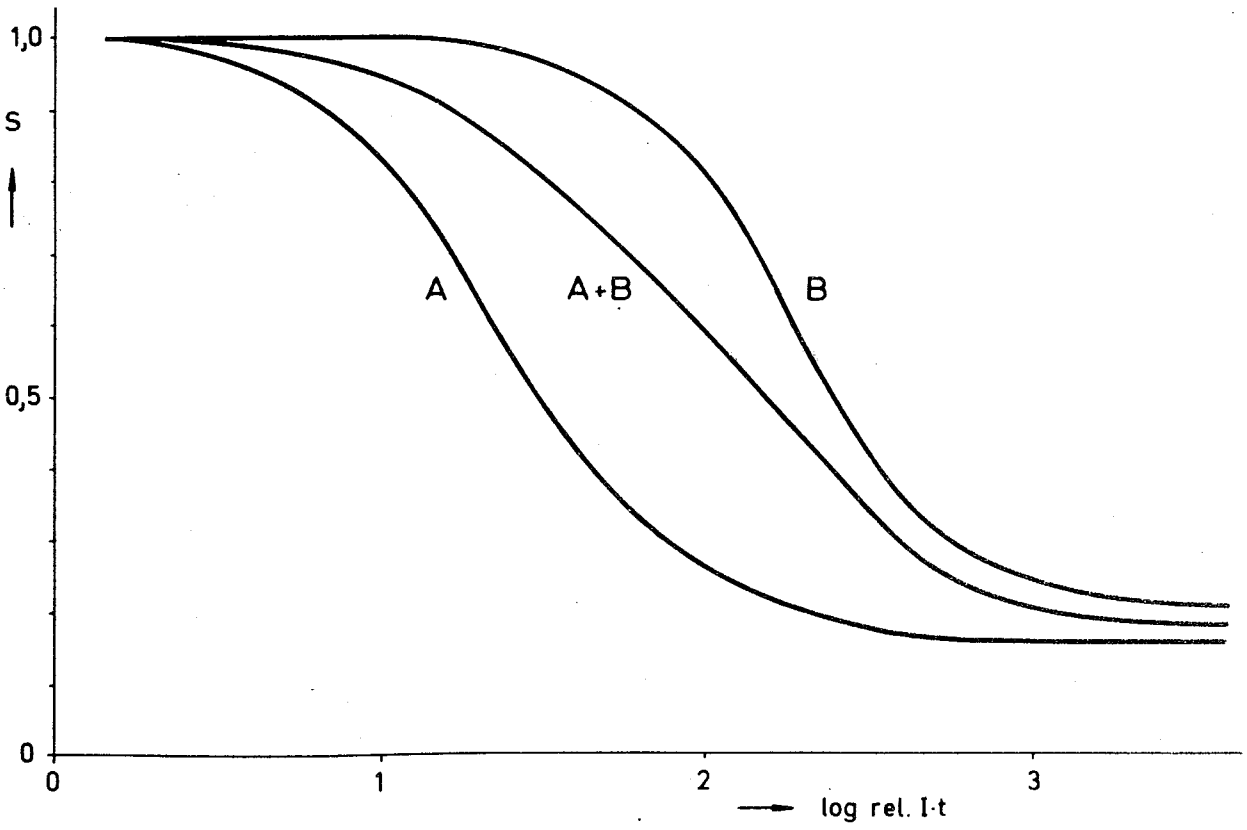
1,0
S
0,5
0
0
1
2
3
log rel. I·t
A
A+B
B

DIRECT-POSITIVE PHOTOGRAPHIC EMULSION CONTAINING, UNFOGGED, MONODISPERSED SILVER HALIDE GRAINS HAVING A LAYERED GRAIN STRUCTURE OF SPECIFIC SILVER CHLORIDE CONTENT

This invention relates to a photographic material for producing direct-positive photographic images which contains at least one unfogged silver halide emulsion layer and to a process for making direct-positive photographic images by fogging development.

In order to produce direct-positive photographic images, it is customary to use silver halide emulsions which have been fogged on the surface. The developable fog is then destroyed upon exposure at the exposed areas but remains intact at the non-lightstruck areas so that a direct-positive image is subsequently obtained by development. The sensitivity of fogged direct-positive silver halide emulsions to light depends on how rapidly the developable fog nuclei on the surface of the silver halide grains are destroyed by imagewise exposure to light. This in turn depends on the size and number of fog nuclei. If these are too large, the sensitivity to light is too low. The extent to which the light-sensitivity of such direct positive silver halide emulsions can be increased by optimizing the size of the fog nuclei is, however, limited because a relatively high degree of fogging is required to obtain a sufficiently high density in the direct-positive silver image and because relatively small fog nuclei are extremely sensitive to oxidation so that silver halide emulsions which are fogged with such small nuclei are not sufficiently stable upon storage. Fogged direct-positive silver halide emulsions are therefore of limited utility.

Silver halide emulsion layers which have not been fogged and in which the sensitivity in the interior of the grain is substantially higher than on the surface have also been described for producing direct-positive photographic images. Exposed materials of the kind are developed under conditions which cause fogging, mainly in the areas which have not been struck by light, so that a direct-positive silver image is obtained. The required fogging of layers which have been exposed imagewise is achieved either by developing with a developer which causes so-called air fogging in the presence of oxygen or by carrying out a process of selective fogging by diffuse exposure to light or treatment with a fogging agent either before or after development.

Although the sensitivity to light obtained by using such unfogged direct-positive silver halide emulsions is relatively high compared with that obtained with fogged direct-positive emulsions, these unfogged emulsions are unsatisfactory in that a relatively high fog is produced also in the exposed areas so that the direct positive images obtained have an interfering background and relatively little differentiation between the areas of highest density and the areas of lowest density.

A certain improvement in this respect can be obtained with the unfogged direct-positive silver halide emulsions described in U.S. patent application Ser. No. 3,761,266 but even these emulsions do not meet the requirements as regards sensitivity to light and whiteness of the image background. Moreover, these emulsions require a certain amount of chemical sensitization of the surface. This must be carried out under accurately controlled conditions in order to ensure that the surface will not be excessively chemically sensitized.

This again has the disadvantage that reproducible preparation of such emulsions is possible only at considerable expense.

It is among the objects of the present invention to provide direct-positive photographic materials containing at least one unfogged direct-positive silver halide emulsion layer which has a high sensitivity to light, yields direct-positive images with very pure image whites and can easily be prepared in a reproducible manner.

We now have found a direct-positive photographic material containing at least one unfogged monodisperse silver halide emulsion layer in which the silver halide grains have a layered grain structure wherein the silver halide grains of the silver chloride emulsion contain a localized first phase with a high silver chloride content of at least 20 mols-% and a second silver halide phase which contains no silver chloride or less silver chloride than the first phase, but wherein the total concentration of silver chloride, based on the total silver halide content of the grain, is at the most 30 mols-%. The second phase preferably contains no silver chloride or contains silver chloride in a concentration which is at least lower by 20 mol-% than the silver chloride concentration in the said first phase.

The total silver halide content based on the total silver halide of the grain is preferably between 5 and 30 mol-%, more particularly between 7,5 and 20 mol-%.

The remaining silver halide of the silver halide grains in the emulsion according to the invention consists of silver bromide or mixtures of silver bromide and silver iodide.

The position in which the phase with the high silver chloride content is localized in the silver halide grain si not in itself critical. This phase may either consist of a core in the grain or form a layer inside the silver halide grain or an external shell. The transition from the phase with a high silver chloride content to layers with a different silver halide composition may form a sharp phase boundary or it may be continuous. Silver halide grains with a sharp phase boundary or with a short transition zone between the phase rich with silver chloride and the zone which has a high silver bromide content are basically suitable but emulsions with grains in which the transition between the phases of different halide compositions is more or less continuous are preferred. The second phase of the silver halide grains of the emulsions according to the invention preferably is free from AgCl.

The unfogged direct-positive silver halide emulsions used for the material according to the invention are of the kind which when exposed to light on the whole form only a latent image in the interior of the grain, i.e. they are emulsions with a substantially higher sensitivity in the interior of the grain than on the surface, preferably they have predominantly internal sensitivity.

Emulsions used for the purpose of the invention are preferably not chemically sensitized on the surface or only to a very slight extent. When samples of exposed material according to the invention are developed with a surface developer of the following composition:

| | |
|---|---|
| p-Hydroxyphenylglycine | 10 g |
| Sodium carbonate (cryst.) | 100 g |
| Water up to | 1000 ml |

they should preferably not give rise to a silver image or only to one of very low density whereas when they are developed with an internal developer of the following composition:

| | |
|---|---|
| Hydroquinone | 15 g |
| Monomethyl-p-aminophenolsulfate | 15 g |
| Sodium sulfite (anhydrous) | 50 g |
| Potassium bromide | 10 g |
| Sodium hydroxide | 25 g |
| Sodium thiosulfate (cryst.) | 20 g |
| Water up to | 1000 ml |

they should give rise to a silver image of sufficient density. When exposed stepwise for 1/100 to 1 second and developed for 3 minutes at 20°C in the internal developer described above, the photographic material according to the invention should in any case reach a maximum density which is at least three times but preferably at least five times greater than that obtained by development of a identically exposed material (development time 4 minutes at 20°C) in the surface developer described above.

The internal sensitivity of the grains of the emulsions is determined by the properties of the phase boundaries or phase transitions between the phase having a high AgCl content and a high AgBr content. The phase boundaries or phase transitions have to be considered as active centers for the deposition of photolytic silver. The high light-sensitivity of the emulsion according to the invention, on the other hand, is not due to foreign inclusions which act as electron traps.

The silver halide emulsions used according to the invention are homodisperse emulsions with a narrow grain size distribution. Preferably about 95 % by weight of the silver halide grains have a diameter which does not deviate by more than 40 % and preferably not more than 30 % from the average grain diameter.

The silver halide grains may have any of the known forms, e.g. they may be cubic or octahedral or they may have a tetradecahedral mixed form.

The absolute value of the average grain size may vary within wide limits. Both fine grained monodisperse silver halide emulsions with an average diameter of less than 0.5 $\mu$m and preferably less than 0.3 $\mu$m and coarse grained monodisperse emulsions with average grain sizes between 0.5 and 2 $\mu$m are suitable, depending on the purpose for which the photographic material is to be used.

In the accompanying drawing results of exposure of emulsions with different grain size and a homo-disperse emulsion are represented in the Figure with the ordinate representing density and the abscissa representing the log It value the respective curves show gradations obtained, as explained in greater detail below.

The silver halide emulsions used according to the invention are prepared by known methods of preparing silver halide emulsions with a layered grain structure. Double jet methods while maintaining certain pAg and pH values are preferably employed. Emulsions with a layered grain structure and methods of preparing them have been described in German Pat. No. 1,169,290 and in British patent specification No. 1,027,146. Reference may also be made to the publication by E. MOISAR and S. WAGNER on "Berichte der Bunsengesellschaft für physikalische Chemie" 67 (1963), pages 356 to 359, and by P. CLAES and R. BERENDSEN in "Photographische Korrespondenz" 101 (1965), pages 37 to 42. The pAg values which must be maintained during precipitation can be checked continuously by electrometric means. The value measured are used to control the rate of inflow of the precipitation components.

The usual hydrophilic film-forming substances are suitable for use as protective colloid or binder for the silver halide emulsion layer, e.g. proteins such as gelatin, alginic acid or derivatives thereof such as its esters, amides or salts, cellulose derivatives such as carboxymethyl cellulose and cellulose sulfates, starches or starch derivatives or hydrophilic synthetic binders such as polyvinyl alcohol, partly saponified polyvinyl acetate, polyvinyl pyrrolidone, etc. The hydrophilic binders in the layers may also be mixed with other synthetic binders in the form of solutions or dispersions such as homopolymers or copolymers of acrylic or methacrylic acid or derivatives thereof such as the esters, amides or nitriles, or vinyl polymers such as vinyl esters or vinyl ethers.

The usual supports may be used for the photographic material according to the invention, e.g. supports made of cellulose esters such as cellulose acetate or cellulose acetobutyrate, polyesters such as polyethylene terephthalate or polycarbonates, especially those based on bis-phenylolpropane. Paper supports with or without water impermeable polyolefine layers such as layers of polyethylene or polypropylene, and supports of glass or metal are also suitable.

The silver halide emulsions used according to the invention may contain the usual emulsion additives, provided only that the surface sensitivity is kept as low as possible.

The emulsions may contain the usual stabilizers, e.g. homopolar or salt type compounds of mercury which contain aromatic or heterocyclic rings (such as mercaptotriazoles), simple mercury salts, sulfonium mercury double salts and other mercury compounds. Azaindenes are also suitable stabilizers, especially tetra- or penta-azaindenes and particularly those which are substituted with hydroxyl or amino groups. Compounds of this kind have been described in the article by BIRR, Z.Wiss.Phot. 47 (9162), pages 2 to 58. Other suitable stabilizers include heterocyclic mercapto compounds, e.g. phenylmercaptotetrazole, quaternary benzothiazole derivatives, benzotriazole and the like.

The emulsions may also be spectrally sensitized. Suitable spectral sensitizers are e.g. the usual mono- or polymethine dyes such as acid or basic cyanines, hemicyanines, streptocyanines, merocyanines, oxonoles, hemioxonoles, and styryl dyes as well as other dyes including also trinuclear or higher nuclear methine dyes, for example rhodacyanines or neocyanines. Sensitizers of this kind have been described, for example, in the work by F. M. HAMER "The Cyanine Dyes and Related Compounds" (1964), Interscience Publishers John Wiley and Sons, New York.

The photographic materials according to the invention are exposed imagewise in the usual manner and are developed in so-called surface developers. By surface developers are meant developer baths which do not contain any silver halide solvents and are therefore not capable of developing internal developable fog nuclei or internal latent image nuclei situated in the interior of the grain. Surface developers can only reduce latent image nuclei or developable fog nuclei situated on the surface of the silver halide grain to image silver. The developing agents used may be any of the usual photographic developers, for example hydroquinone, aminophenols, especially p-methylaminophenols, and superadditive developers preferably those of the 3-pyrazolidone series, in particular 1-phenyl-3-pyrazolidone, as well as ascorbic acid or ascorbic acid derivatives. For developing the photographic materials according to the invention by color-forming developing processes, the usual color developers may be used, in particular those of the p-phenylene diamine series. The exposed materials may, of course, also be processed with mixtures of various developing agents.

The developing agents may be added either by the aqueous developer bath or to the photographic material itself, e.g. to the silver halide emulsion layer on or adjacent layer. If the developing agents are situated in a layer of the photographic material, then a so-called activator bath is used for development. This bath may contain mainly alkali for adjusting the pH to the necessary value for development in addition to additives which promote and control development. After development, the films are fixed and washed in the usual manner.

As already mentioned above, the photographic materials according to the invention which contain at least one unfogged direct-positive silver halide emulsion layer are developed under fogging conditions after exposure. This may be carried out by known methods as described for instance in U.S. Pat. No. 3,761,266. For example, socalled aerial fogging surface developer which produce a so-called air fog in the presence of atmospheric oxygen may be used. Developers of this kind have been described e.g. in German Pat. No. 850,383 and in U.S. Pat. No. 2,497,875.

Fogging may also be achieved by diffuse exposure, e.g. exposure to flashlight immediately before or during development. Processes of this kind have been described, for example, in U.S. Pat. Nos. 2,456,953 and 2,592,298 and in British patent specification Nos. 1,150,553; 1,151,363; 1,195,837; 1,195,838 and 1,187,029.

According to a third method, fogging is achieved by treatment with a reducing agent before or during development of the exposed layer.

Particularly suitable fogging agents are hydrazine and substituted hydrazines such as alkyl or aryl hydrazines, hydrazinocarboxylic acids, acylated hydrazines, alkyl sulfonamidoarylhydrazines, naphthylhydrazine sulfonic acids and other hydrazine derivatives. Reference is made to U.S. Pat. Nos. 2,563,785; 2,588,982; 2,604,400; 2,618,656; 2,663,732; 2,675,318; 2,685,514; 3,227,552 or 3,565,620 or to British patent specification No. 1,269,640.

Quaternary ammonium salts used either alone or together with hydrazines are also suitable fogging agents, especially cyclic quaternary ammonium salts such as those described in U.S. Pat. No. 3,615,615 or heterocyclic quaternary salts according to U.S. Pat. Nos. 3,737,738 and 3,719,494.

The fogging agents may, like the developing agents, be used either in one of the layers of the photographic material or in the developer baths, or they may be used as aqueous solutions in which the exposed layers are treated before development.

The concentration of the fogging compound may vary within wide limits. It may depend on the effect desired, the activity of the fogging agent or the nature of the unfogged direct-positive silver halide emulsion. The optimum concentration for any particular purpose can be determined by a few simple tests.

The developers may also contain the usual additives used in photographic developers, such as antioxidants, water softeners, stabilizers, especially those of the benzotriazole series or organic mercapto compounds, particularly heterocyclic mercapto compounds, as well as the usual development accelerators, in particular derivatives of polyalkylene oxides or quaternary ammonium compounds.

In some cases it may be advantageous to add compounds which liberate iodide compounds in the course of the process to the photographic material or to one of the treatment baths. Reference is made to British patent specifications No. 1,151,363; 1,187,029 and 1,195,837.

The material according to the invention may also contain halogen acceptors in known manner, especially those which are relatively difficult to reduce but readily oxidized.

This invention may be employed for producing black-and-white images and for producing colored photographic images. The field of application may vary according to the gradation of the silver halide emulsion layer, for example photographic materials which contain emulsions with a steep gradation may be used for phototechnical purposes or those with emulsions which have a medium or flat gradation may be used for producing black-and-white half tone images or X-ray pictures.

Photographic emulsion of the present invention which have a flat gradation and a relatively low maximum density, e.g. up to 0,8 may be used for the production of colored photographic direct-positive images, e.g. by the known method of colorforming development in the presence of color couplers which react with the oxidation product of colorforming p-phenylene diamine developers to form dyes.

The color couplers may be added to the direct-positive unfogged silver halide emulsion layer or to the developer according to the principle of the so-called developing in process. Incorporation of the color couplers into the emulsion layer may be carried out by the usual methods, for example water soluble color couplers which contain one or more sulfo or carboxyl groups in the form of the free acid or a salt may be added to the casting solution for the emulsion from an aqueous solution, optionally in the presence of alkali. Color couplers which are insoluble or insufficiently soluble in water are added in the form of a solution in a suitable water miscible or water immiscible high-boiling, oil forming or low-boiling organic solvent or solvent mixture. If desired, this solution may be dispersed in the aqueous solution of a protective colloid in the presence of a surface active agent.

When multilayered color photographic materials are used with a transparent layer support, the invention may also be used to produce direct-positive, transparent photographic color images. The black-and-white development step and intermediate step of diffuse exposure to light which are necessary in the usual reversal processes are then obviated. The material according to the invention may also be used in known manner for the silver dye bleaching process. In that case, negative images of the original are obtained since the image is again reversed when dye bleaching is carried out.

This invention is particularly advantageous for instant color processes or color transfer processes carried out in known manner. In these processes, the dyes for the partial color images diffuse into an image receiving layer where they become firmly fixed or the color couplers diffuse into the image receiving layer where they are converted to image dye upon the usual colorforming development.

The light-sensitive element in these cases generally consist of three light-sensitive emulsion layers, each of which is associated with a color producing system. By color producing system is meant a compound incorporated in the layer in a diffusion resistant form which constitutes a dye or dye precursor which, when development is carried out, reacts in the presence of the alkaline processing substance with the oxidation products formed by imagewise oxidation of the developer to split off diffusible dyes, preferably dyes which contain acid groups. Various chemical compounds are available for this purpose. Diffusion resistant, color producing substances described in U.S. Pat. No. 3,628,952, for example, are particularly suitable for this purpose. These compounds react with oxidation products of black-and-white or color developers to split off diffusible dyes. Another useful class of compounds is described in British patent specification No. 904,364. The compounds mentioned there react with the oxidized color developer to form diffusible dyes which generally belong to the class of azomethine dyes. Another suitable color producing system has been described in U.S. Pat Nos. 3,443,939 and 3,443,940. In this system, the action of the oxidized developer substances causes ring closure to split off diffusible dyes.

Color transfer processes and couplers used in such process which are suitable for the purpose of this invention have also been described in U.S. Pat. Nos. 2,983,606; 3,087,817; 3,185,567; 3,227,550; 3,227,551; 3,227,552; 3,227,554; 3,253,915; 3,415,644; 3,415,645 and 3,415,646.

The light-sensitive materials used for such instant color processes are generally arranged as follows:

blue sensitive silver halide emulsion layer,
layer which releases yellow dye,
separating layer,
green sensitized silver halide emulsion layer,
layer which releases magenta dye,
separating layer,
red sensitized silver halide emulsion layer,
layer which releases cyan dye.

EXAMPLE 1 a. A homodisperse AgBr emulsion with cubic crystals with an edge length of about 0.2 μm is prepared by the simultaneous inflow of 3N KBr and 3N $AgNO_3$ solutions at a rate controlled by the pAg into a 3 % gelatin solution which has been heated to a temperature of 50°C (double jet process — pAg 8).

b. A shell of AgCl is precipitated on the original crystals of a portion of the AgBr emulsion prepared according to (a) by the double jet method by adding simultaneously 3N KCl and 3N $AgNO_3$ solutions at a rate controlled by the pAg, the quantity of AgCl precipitated in this way being 70 mols-%, based on the quantity of AgBr in the original emulsion (pAg 7).

Precipitation was then continued by the double inflow of 3N KBr and 3N $AgNO_3$ solutions controlled by the pAg, the quantity of AgBr precipitated on the AgCl shell being now 630 mols-%, based on the quantity of AgBr in the original emulsion. The resulting homodisperse emulsion contains grains with a length of edge of about 0.4 μm in the interior of which is a layer of AgCl containing 8.8 mols-% of AgCl, based on the total quantity of halide.

c. The emulsion was solidified in the usual manner, freed from soluble alkali metal salts by washing, melted, adjusted to a pAg of about 9 and cast on a layer support of polyethylene terephthalate. The emulsion was then exposed behind a grey wedge in a sensitometer customarily employed in the art and treated with a developer of the following composition:

| | |
|---|---|
| N-ethyl-N-β-hydroxyethyl-p-phenylenediamine | 10 g |
| Sodium sulfite (anhydrous) | 2 g |
| Trisodium phosphate (cryst.) | 40 g |
| Sodium hydroxide | 5 g |
| Benzimidazole | 0.05 g |
| Acetylphenylhydrazide | 1 g |
| Water up to | 1000 ml |

The developed material was fixed and washed in known manner. A direct-positive step wedge was obtained and examined sensitometrically in the usual manner. The relative sensitivity ($S_{rel}$) was given as the reciprocal value of the exposure which results in a density which is 0.1 units below the maximum density ($D_{max}$), using as reference value for sensitivity S = 100 a comparison emulsion with an average grain size of 0.4 μm which had been prepared by converting an AgC emulsion with excess KBr according to U.S. Pat. No. 2,592,250 and exposed and developed under the same conditions.

The sensitometric properties of the comparison emulsion and of the emulsion according to the invention prepared in this example are summarized below:

| | $S_{rel}$ | $D_{max}$ | $D_{min}$ |
|---|---|---|---|
| Comparison emulsion | 100 | 1.04 | 0.80 |
| Emulsion according to the invention | 350 | 0.65 | 0.11 |

A comparison of the two sets of figures shows convincingly the gain in sensitivity and contrast (indicated by the difference $D_{max} - D_{min}$) and the significantly lower minimum density $D_{min}$ of the emulsion according to the invention.

The maximum density can easily be increased to the desired value, e.g. 1.5 – 2.0, by increasing the quantity of silver halide applied without thereby increasing the excellent value for $D_{min}$.

The above comparison emulsion was also used as standard emulsion in the following examples.

EXAMPLE 2

AgCl was first precipitated on the emulsion prepared in Example 1 followed by the precipitation of AgBr as described in 1 *b*, 10 mols-% of the total quantity of silver halide precipitated consisting of AgCl and the remaining 90 mols-% of AgBr. A homodisperse, cubic emulsion with a length of edge of 0.6 μm as obtained. The silver halide grains of the emulsion have a composite grain structure consisting of a silver bromide core, a layer of silver chloride, a layer of silver bromide (as the emulsion of Example 1), a further layer of silver chloride and an outer shell of silver bromide.

A direct-positive step wedge was obtained after processing, exposure and development as described in Example 1. The following values were obtained in the sensitometric tests. The comparison emulsion is the same as used in Example 1.

| | |
|---|---|
| $S_{rel}$: | 7000 |
| $D_{max}$: | 0.5 |
| $D_{min}$: | 0.06 |
| $D_{max}/D_{min}$: | 0.83 |

If the silver halide concentration is increased by the factor 3 and the processing is identical, the following sensitometric results are obtained:

| | |
|---|---|
| $S_{rel}$: | 7000 |
| $D_{max}$: | 1.76 |
| $D_{min}$: | 0.21 |
| $D_{max}/D_{min}$: | 8.5 |

EXAMPLE 3

Using the original AgBr emulsion described in Example 1 *a*, 7 times its quantity of silver halide was precipitated on it by the triple inflow of 3N KBr, 3N KCl and 3N $AgNO_3$ solutions, the inflow being controlled by the pAg value (pAg 7 – 8). The chloride content was continuously raised to 100% in the course of precipitation and then reduced to zero, based on the quantities of halide solutions added. The total quantity of AgCl incorporated in the emulsion was 15 mols-% of the total quantity of silver halide precipitated on the given AgBr grains. A homodisperse silver halide emulsion with cubic grains having an edge length of about 0.4 μm was obtained. The AgCl content of the grains (now based on the total grain) was 13.1 mols-%.

A direct-positive wedge was obtained after processing, exposure and development as indicated in Example 1 *c*. The following values were obtained from sensitometric determinations:

| | |
|---|---|
| $S_{rel}$: | 800 |
| $D_{max}$: | 0.60 |
| $D_{min}$: | 0.10 |

EXAMPLE 4

Another shell of silver halide was precipitated as described in Example 3 on the AgBr emulsion described in Example 3 having the localized concentration of AgCl in the AgCl layer at first increased and then decreased. Here again the chloride content continuously rose from zero to 100 % in the course of precipitation and then fell to zero %, based on the quantity of halide solutions added. The total quantity of AgCl incorporated was 15 mols-% of the total quantity of halide precipitated on the grains in the original emulsion. A homodisperse silver halide emulsion with cubic grains having a length of edge of 0.6 μm was obtained in which the AgCl content in both shells together amounted to 14.4 mols-%, based on the total quantity of silver halide. The emulsion was ripened at 50°C for 30 minutes after the addition of 10 ml of $10^{-3}$ molar $Na_2S_2O_3$ solution per mol of silver halide.

A direct-positive wedge with the following sensitometric data was obtained after processing, exposure and development as described in Example 1 c:

| | |
|---|---|
| $S_{rel}$: | 3500 |
| $D_{max}$: | 0.65 |
| $D_{min}$: | 0.06 |

EXAMPLE 5

A homodisperse AgBr emulsion with cubic grains having an edge length of 0.6 μm was prepared by the double inflow of 3N KBr and 3N $AgNO_3$ solutions controlled by the pAg. The starting emulsion thus obtained was divided into several samples. Precipitation by double inflow (double jet) was now continued to produce shells in which the silver halide content was about 10 mols-%, based on the silver halide content of the original emulsion. Layers of the same thickness but differing localized molar ratios of AgCl:AgBr were produced with the different samples by varying the chloride:bromide ratio in the alkali metal halide solutions used for precipitation.

The samples were cast on supports of polyethylene terephthalate in a thickness corresponding to an application of 3 g of silver in the form of silver halide per $m^2$. Direct-positive wedges with the following sensitometric properties were obtained from the samples after exposure and processing as described in Example 1 c:

| | Mol-% of AgCl in the shell | $S_{rel}$ | $D_{max}$ | $D_{min}$ | Gradation $\gamma$ |
|---|---|---|---|---|---|
| A | 90 | 3200 | 0.55 | 0.09 | 0.61 |
| B | 70 | 2000 | 0.54 | 0.09 | 0.30 |
| C | 50 | 1600 | 0.45 | 0.09 | 0.15 |
| D | 20 | 800 | 0.57 | 0.12 | 0.11 |

A comparison between emulsions A – D shows that the threshold sensitivity and the gradation of the positive density curve decrease with decreasing localized AgCl concentration in the shell which contains AgCl.

EXAMPLE 6

An AgCl emulsion with a cubic crystal structure, in which the grains had an edge length of 0.25 μm, was prepared by the double jet method by simultaneously adding 3N KCl and 3N $AgNO_3$ solutions controlled by the pAg. KBr and $AgNO_3$ solutions were then introduced by double inflow to precipitate AgBr on ;the original AgCl emulsion. The resulting emulsion was homodisperse and contained cubic grains with a length of edge of 0.65 μm and an AgCl content of 5.8 mols-%.

A direct-positive density wedge was obtained after processing, exposure and development as described in Example 1*c*. The following sensitometric were was obtained:

| | |
|---|---|
| $S_{rel}$: | 6400 |
| $D_{max}$: | 0.52 |
| $D_{min}$: | 0.06 |

EXAMPLE 7

AgBr/I was precipitated on the original AgCl emulsion described in Example 6 by basically the same method of controlled double inflow of a 3N $AgNO_3$ solution and a solution which was 2.985 molar with respect to KBr and 0.015 molar with respect to KI. The resulting emulsion was homodisperse and contained cubic grains with a length of edge of 0.65 μm.

The emulsion was processed as described in Example 1 *c*. The following data were obtained from sensitometric examination of the direct-positive density wedge:

| | |
|---|---|
| $S_{rel}$: | 4000 |
| $D_{max}$: | 0.48 |
| $D_{min}$: | 0.07 |

EXAMPLE 8

The same quantity of AgBr as in Example 6 was precipitated on the original AgCl emulsion described in Example 6 by controlled double inflow of 3N $AgNO_3$ and 3N KBr solutions at a pAg of 10. The resulting emulsion was homodisperse and owing to the high pAg value the grains had an octahedral crystal structure with a crystal volume equal to that of the cubic grains mentioned in Example 6 which had an edge length of about 0.65 $\mu$m.

The emulsion was processed as described in Example 6. The following data were obtained from sensitometric examination of the direct-positive density wedge:

| | |
|---|---|
| $S_{rel}$: | 4000 |
| $D_{max}$: | 0.55 |
| $D_{min}$: | 0.08 |

EXAMPLE 9

AgBr/I was precipitated as described in Example 7 on the original AgCl emulsion mentioned in Example 6 by controlled double inflow of a 3N $AgNO_3$ solution and a solution which has 2.985 molar with respect to KBr and 0.015 molar with respect to KI. The resulting emulsion was homodisperse and contained cubic grains with an edge length of 0.4 $\mu$m.

After the emulsion had been processed as described in Example 1 *c*, part of it was cast without the addition of optical sensitizer (Sample 0 ) and another part after it had been optically sensitized with the following dyes:

The sensitometric data obtained after exposure behind a green filter and processing as described in Example 1 *c* are summarized in the Table below in which the sensitivity data $S_{rel,gr.}$ for green light are based on the standard value $S_{rel}$ = 100 given in Example 1 *c* which is obtained when the standard emulsion prepared according to prior art is exposed to white light.

| Additive | Quantity of sensitizer in mg/mol AgX | $S_{rel,gr.}$ | $D_{max}$ | $D_{min}$ |
|---|---|---|---|---|
| 0 | — | 0 | 0 | 0 |
| I | 358 | 400 | 0.42 | 0.09 |
| II | 358 | 400 | 0.43 | 0.07 |

The maximum density can again be increased by increasing the quantity of silver applied without thereby causing an unwanted increase in the value for $D_{min}$.

EXAMPLE 10

The procedure was the same as in Example 9 except that the following sensitizers were added:

I

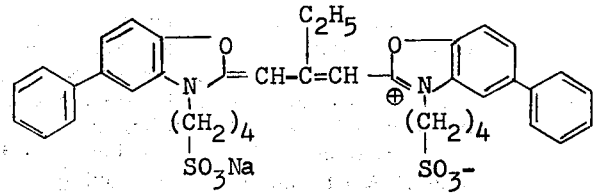

II

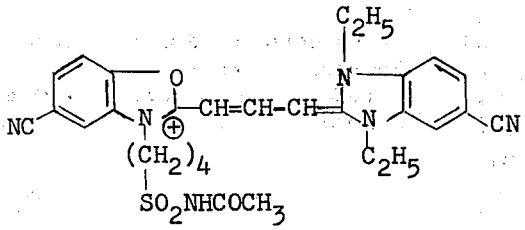

III

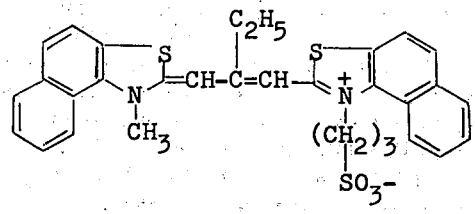

IV

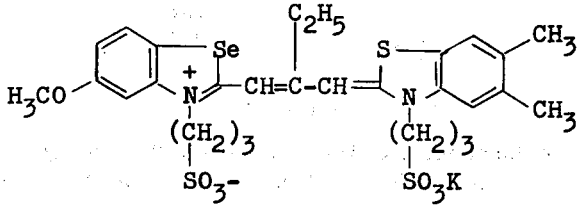

The sensitometric data obtained after exposure behind a red filter and processing as in Example 1 *c* are summarized in the Table below in which the sensitivity $S_{rel,red}$ for red light is based on the standard $S_{rel} = 100$ used in Example 1 *c*) which is the value obtained when the standard emulsion prepared according to prior art is exposed to white light.

| Additive | Quantity of sensitizer in mg/mol of AgX | $S_{rel,red}$ | $D_{max}$ | $D_{min}$ |
|---|---|---|---|---|
| 0 | — | 0 | 0 | 0 |
| III | 358 | 200 | 0.70 | 0.12 |
| IV | 358 | 400 | 0.69 | 0.13 |

The maximum density can be increased by increasing the amount of silver applied without at the same time causing unwanted increase in the value for $D_{min}$.

EXAMPLE 11

The procedure was the same as in Example 9 but the emulsion was sensitized panchromatically with a combination of 350 mg/mol AgHal of a dye which sensitizes in the red spectral region, represented by the formula V 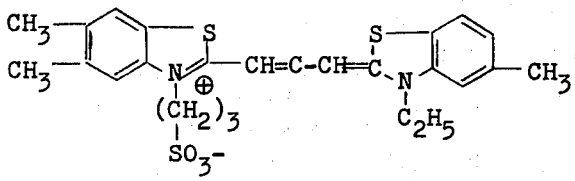

and 350 mg/mol AgHal of a dye of the following formula:

VI 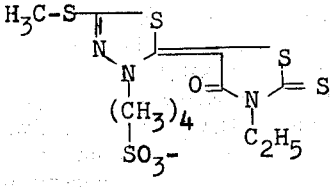

which absorbs in the blue region of the spectrum and with a combination of 350 mg/mol of AgHal of a dye of the following formula:

VII 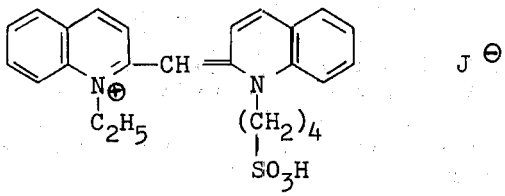

which absorbs in the green region of the spectrum or 350 mg/mol of AgHal of a dye of the following formula:

VIII 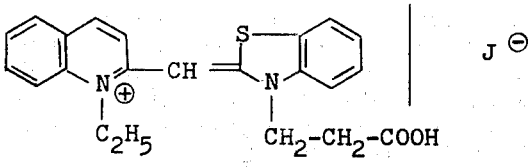

which absorbs in the green region of the spectrum, in each case together with a supersensitizer of the formula:

IX 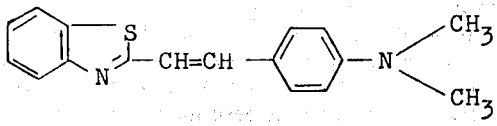

used in a quantity of 35 mg/mol AgHal or a supersensitizer of the formula:

X 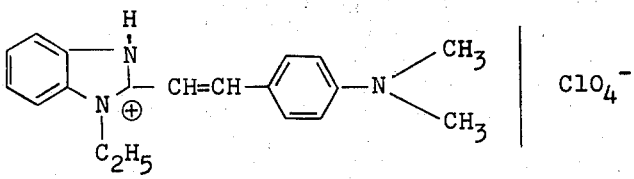

used in a quantity of 35 mg/mol AgHal.

The sensitometric data of the direct-positive characteristic curve obtained after exposure to unfiltered light as described in Example 1 *c* are summarized below:

| Additive | $S_{rel}$ | $D_{max}$ | $D_{min}$ |
|---|---|---|---|
| 0 | 800 | 0.65 | 0.09 |
| V + VI + VII + XI | 3200 | 0.60 | 0.10 |
| V + VI + VIII + X | 3200 | 0.58 | 0.09 |

The maximum density can again be increased by increasing the amount of silver applied without at the same time causing any unwanted increase in the value for $D_{min}$.

EXAMPLE 12

Two homodisperse emulsions

A. as described in Example 4 with a grain size of 0.6 μm and

B. as described in Example 3 with a grain size of 0.4 μm were prepared by the double jet method controlled by pAg. The emulsions were cast on a film support both separately and as a 1:1 mixture in thicknesses such that the maximum density obtained after development performed as described in Example 1 *c* was $D_{max} = 1$. The density curve obtained after the individual emulsions (A) and (B) had been exposed imagewise and processed as described in Example 1 is shown in the attached Figure. It shows that the gradation of the originally steeper homodisperse emulsions A ($\gamma = 0.77$) and B ($\gamma = 0.76$) are flattened to $\gamma = 0.51$.

EXAMPLE 13

AgBr was precipitated by controlled double inflow of KBr and $AgNO_3$ solutions on the original AgCl emulsion described in Example 6 in which the grains had an edge length of 0.25 μm. Precipitation was continued until the crystals of the emulsion contained 10 mols-% of AgCl (in the core) and 90 mols-% of AgBr (in the shell) (Emulsion XI).

In addition, an emulsion which had exactly the opposite halide composition, namely 10 mols-% of AgBr in the core and 90 mols-% of AgCl in the shell (Emulsion XII), was prepared as described in Example 4 of U.S. Pat. No. 3,761,266. The grains of emulsions XI and XII had approximately the same size, the edge length being in both cases about 0.54 μm. The sensitometric data obtained after processing according to Example 1 *c* were as follows:

| | XI | XII |
|---|---|---|
| $S_{rel}$ | 1600 | 100 |
| $D_{max}$ | 0.75 | 1.1 |
| $D_{min}$ | 0.08 | 0.58 |
| $D_{max}/D_{min}$ | 9.4 | 1.9 |

The sensitometric results show the substantially higher sensitivity and substantially higher density ratio $D_{max}/D_{min}$ of emulsion XI according to the invention.

We claim:

1. A photographic material for producing direct-positive photographic images having at least one silver halide emulsion layer having unfogged and monodispersed silver halide grains having a layered grain structure wherein 95% by weight of the silver halide grains of the emulsions have a grain diameter which does not deviate by more than 40% from the average grain diameter and which grains are not or only slightly chemically sensitized at the surface wherein the improvement comprises the unfogged silver halide grains of the emulsion have at least two phases, a localized first phase of the silver halide grains has at least 20 mol percent of silver chloride based on the total mol percent of silver halide and a second phase of the silver halide grains has less silver chloride than said first phase and said silver halide grains contain not more than 30 mol percent of silver chloride based on the silver halide of said grains based on the total mol percent of silver halide, said silver halide grains when exposed for between 1/100 to 1 second and developed for 3 minutes at 20° C with an internal developer of the following description:

| | |
|---|---|
| Hydroquinone | 15 g |
| Monomethyl-p-aminophenolsulfate | 15 g |
| Sodium sulfite (anhydrous) | 50 g |
| Potassium bromide | 10 g |
| Sodium hydroxide | 25 g |
| Sodium thiosulfate (cryst.) | 20 g |
| Water up to | 1000 ml |

provide a silver image of density which is at least three times that when similarly exposed and developed for 4 minutes at 20°C with a surface developer of the following composition:

| | |
|---|---|
| p-Hydroxyphenylglycine | 10 g |
| Sodium carbonate (cryst.) | 100 g |
| Water up to | 1000 ml. |

2. The material of claim 1, wherein the total concentration of silver chloride, based on the total silver halide of the grain, is less than 20 mols-%.

3. The material of claim 1, wherein the second phase of said silver halide grains has a silver chloride concentration which is by at least 20 mol-% lower than the silver chloride concentration in the said first phase of said silver halide grains.

4. The material of claim 2, wherein the total silver chloride concentration, based on the total silver halide of the grain, is between 7.5 and 20 mol-%.

5. The material of claim 1, wherein the silver halide grains of the emulsion are free of chemically sensitization on the surface.

6. The material of claim 1, wherein the silver halide grains of the emulsion have a regular crystal form.

7. The photographic material as claimed in claim 1, wherein the second phase of said silver halide grains is substantially free of silver chloride.

8. The process for producing direct-positive photographic images in a photographic material which comprises (a) imagewise exposing a photographic material comprised of a support and at least one light-sensitive silver halide emulsion layer which contains monodispersed, unfogged, silver halide grains with a layered grain structure wherein 95% by weight of the silver halide grains of the emulsions have a grain diameter which does not deviate by more than 40% from the average grain diameter; (b) in a surface developer developing said exposed material under fogging conditions by an additional processing step, wherein the silver halide grains of said emulsion are not or only slightly chemically sensitized at the surface and wherein the improvement comprises the said silver halide grains of the silver halide emulsion contain a localized first phase with a silver chloride content of at least 20 mol-% based on the total mol percent of silver halide and a second silver halide phase which contains less silver chloride than the said first silver halide phase, but wherein the total concentration of silver chloride, based on the the total silver halide content of the grain, is less than 30 mols-% based on the total mol percent of silver halide, said silver halide grains when exposed for between 1/100 and 1 second and developed for 3 minutes at 20°C with an internal developer of the following description:

| | |
|---|---|
| Hydroquinone | 15[h]g |
| Monomethyl-p-aminophenolsulfate | 15 g |
| Sodium sulfite (anhydrous) | 50 g |
| Potassium bromide | 10 g |
| Sodium hydroxide | 25 g |
| Sodium thiosulfate (cryst.) | 20 g |
| Water up to | 1000 ml |

provide a silver image of density which is at least three times that when similarly exposed and developed for 4 minutes at 20°C with a surface developer of the following composition:

| | |
|---|---|
| p-Hydroxyphenylglycine | 10 g |
| Sodium carbonate (cryst.) | 100 g |
| Water up to | 1000 ml. |

9. The process of claim 8, wherein the total concentration of silver chloride, based on the total silver halide content of the grain, is less than 20 mols-%.

10. The process of claim 8, wherein the second phase of the silver halide claims is substantially free of silver chloride.

11. The process of claim 8, wherein the additional step of fogging comprises developing said exposed material in a surface developer in the presence of a fogging agent.

12. The process of claim 8, wherein the additional step of fogging comprises uniformly exposing said imagewise exposed material with flashlight during development in a surface developer.

13. The process of claim 8, wherein the additional step of fogging comprises developing the said exposed material in a silver halide aerial fogging surface developer.

* * * * *